US005593464A

United States Patent [19]

Cook et al.

[11] Patent Number: 5,593,464

[45] Date of Patent: Jan. 14, 1997

[54] FUEL ADDITIVES

[75] Inventors: Stephen L. Cook, Chester; Maurice W. Rush, Buckingham; Paul J. Richards, Milton Keynes; Donald Barr, Little Sutton, all of United Kingdom

[73] Assignee: The Associated Octel Company Limited, London, England

[21] Appl. No.: 406,863

[22] PCT Filed: Aug. 2, 1994

[86] PCT No.: PCT/GB94/01695

§ 371 Date: May 17, 1995

§ 102(e) Date: May 17, 1995

[87] PCT Pub. No.: WO95/04119

PCT Pub. Date: Feb. 9, 1995

[30] Foreign Application Priority Data

Aug. 2, 1993 [GB] United Kingdom ..... 9315974

[51] Int. Cl.[6] ..... C10L 1/30

[52] U.S. Cl. ..... 44/362; 44/358; 44/437

[58] Field of Search ..... 44/358, 362

[56] References Cited

U.S. PATENT DOCUMENTS

| | | | |
|---|---|---|---|
| 3,410,670 | 11/1968 | LeSuer | 44/401 |
| 3,794,473 | 2/1974 | Eisentraut et al. | 44/362 |
| 4,036,605 | 7/1977 | Hartle | 44/362 |
| 4,211,535 | 7/1980 | Hartle | 44/362 |
| 4,251,233 | 2/1981 | Sievers et al. | 44/362 |
| 4,336,148 | 6/1982 | Wirth et al. | 44/358 |

FOREIGN PATENT DOCUMENTS

| | | |
|---|---|---|
| 525890 | 9/1940 | United Kingdom . |
| 2254610 | 10/1992 | United Kingdom . |
| 2259701 | 3/1993 | United Kingdom . |
| 95/04119 | 2/1995 | WIPO . |

*Primary Examiner*—Ellen M. McAvoy

*Attorney, Agent, or Firm*—Fay, Sharpe, Beall, Fagan, Minnich & McKee

[57] ABSTRACT

The emission of particulates and unburnt hydrocarbons in the exhaust gas emissions from liquid hydrocarbon fuels, especially diesel fuels and fuel oils is reduced by incorporating into the fuel an effective amount of an oil-soluble alkali, alkaline earth or rare earth complex of the formula:

$$M(R)_m.nL$$

wherein M is the metal cation of valency m, R is the residue of an organic compound RH containing an active hydrocarbon atom, preferably a beta-diketone, n is an integer usually 1, 2, 3 or 4, and L is an organic donor ligand molecule, i.e., a Lewis base.

22 Claims, No Drawings

FUEL ADDITIVES

This invention relates to additives for liquid hydrocarbon fuels, and fuel compositions containing them. More specifically the invention relates to additives effective to reduce the particulate and/or unburnt hydrocarbon content of exhaust gas emissions from distillate hydrocarbon fuels such as diesel and heating oils.

Diesel fuels and diesel engines are particularly prone to the emission of small size particulate material in the exhaust gas, and these particulates are known to contain harmful pollutants. These particulates include not only those which are visible as smoke emission, and to which diesel engines are prone especially when the engine is overloaded, worn, badly maintained or quite simply dirty, but also those which emerge from lightly loaded, clean diesel engines and which are normally invisible to the naked eye.

As indicated, particulate emission by diesel engines is a major source of harmful atmospheric pollution, and an effective particulate suppressant for diesel fuels is highly sought after.

Similar problems can also arise during the combustion of other distillate fuel oils, e.g. heating oils.

Yet another problem associated with liquid hydrocarbon fuels of all kinds is that of incomplete combustion (which is largely responsible for soot formation anyway) resulting in the emission of unburnt hydrocarbons into the atmosphere as an atmospheric pollutant. A need exists therefore for additives effective to reduce the content of unburnt hydrocarbon in the exhaust gas emissions from liquid hydrocarbon fuels.

In the proceedings of the Nineteenth Symposium (international) on Combustion, 1983, p. 1379, published by the Combustion Institute, Haynes and Jander have disclosed that alkali and alkaline earth metals can reduce sooting in premixed hydrocarbon flames.

More specifically related to diesel engines, proposals have been made concerning the use of rare earth metals to reduce particulate emissions by diesel engines, see, for example, U.S. Pat. Nos. 4,522,631, 4,568,357 and 4,968,322.

In U.S. Pat. No. 4,522,631 particulate emission from diesel fuel is reduced by adding to the fuel prior to combustion, an additive composition comprising the combination of an oxygenated organic compound, e.g. alcohol, aldehyde, ketone or alkylcarbitol, preferably n-hexylcarbitol, and an oil-soluble rare earth compound, preferably a cerium carboxylate salt such as cerium octanoate.

In U.S. Pat. No. 4,568,357 a combination of manganese dioxide and cerium (III) naphthenate is added to diesel fuels to facilitate the regeneration of ceramic particulate traps used with diesel engines to entrap particulates in the exhaust gas, and which traps require periodic regeneration by burning off the trapped particulates. The manganese oxide and cerium naphthenate act synergistically to lower the burn-off temperature required to effect the regeneration of the trap. The U.S. Pat. No. 4,568,357 patent does not suggest that the cerium compound is effective to reduce particulate emission in the first place.

In U.S. Pat. No. 4,968,322 a combination of rare earth metal soaps preferably selected from a cerium soap, a neodymium soap and a lanthanum soap, are added to heavy fuel oils to improve the combustion rate of the fuel.

Other attempts to reduce particulate emission from diesel fuels, mostly based on calcium and barium soaps have been reported in U.S. Pat. Nos. 2,926,454, 3,410,670, 3,413,102, 3,539,312 and 3,499,742.

In addition to the foregoing, oil-soluble chelates of Ce(IV) such as ceric 3,5-heptanedionate, have been proposed as antiknock compounds in gasoline fuels for use in spark ignition internal combustion engines as an alternative to lead tetraalkyls such as tetraethyllead and tetramethyllead, see U.S. Pat. No. 4,036,605. However there is no suggestion that such chelates have any particulate suppressant activity in diesel fuels.

Other metals such as copper, manganese and iron have also been considered but give rise to other environmental concerns and/or concerns regarding damage or wear to the engine itself.

In accordance with the present invention it has been found that various organometallic coordination complexes of alkali, alkaline earth and rare earth metals, including mixtures thereof, are effective particulate suppressants for liquid hydrocarbon fuels, especially distillate hydrocarbon fuels such as diesel and fuel oil, besides providing a number of added advantages such as high solubility and dispersibility in the fuel, good thermal stability and good volatility.

A particular advantage of such complexes is their low nuclearity, many being monomeric in character, although some are dimeric or trimeric, or higher. This low nuclearity means that, in contrast to metallic soaps, the traditional method of providing oil-soluble metallic compounds, the complexes used in accordance with the present invention provide a uniform distribution of metal atoms throughout the fuel, each metal atom theoretically being available to take part in whatever mechanism it is that results in the reduction of particulate emission when the fuel is burned, this availability being enhanced moreover by the volatility of the complexes. This is in complete contrast to the metallic soaps, which consist essentially of individual micelles containing an unknown number of metal, e.g. alkali or alkaline earth metal, cations surrounded by a shell of acid groups derived from a long chain fatty acid or alkyl sulphonic acid bound to the metal atoms on the surface of the particle. Whilst such soaps are oil-soluble, the metal will not be uniformly dispersed throughout the fuel as individual atoms, but as clusters each surrounded by a shell of fatty acid or alkylsulphonate molecules. Not only that, but only a limited number of metal atoms are available on the surface of the micelle for reaction, so the effectiveness of those soaps is low. Moreover, since the soaps are non-volatile there is a significant risk of increased deposit formation in the engine itself and in the fuel injectors, including the fuel injectors of oil-fired boilers etc., quite apart from the fact that the combustion process is a vapour phase reaction, essentially requiring the particulate suppressant itself to be volatile in order to have any effect.

Whilst the reasons for beneficial effect of the present coordination complexes as particle suppressants in liquid hydrocarbon fuels is not understood, it is probable that this is due to catalytic oxidation activity of the metal atoms adsorbed onto soot particles formed during the combustion process and effective to catalyse the oxidation of those particles and thus to effect their removal from the exhaust gas stream, either directly or in conjunction with catalytic or trap devices. However, that is speculation, and the mode of action of the complexes as particle suppressants in hydrocarbon fuels in accordance with this invention is not important.

In one aspect of the present invention, therefore, there is provided a particulate suppressant additive for liquid hydrocarbon fuels comprising an organic, fuel-soluble carrier liquid, preferably hydrocarbon, miscible in all proportions with the fuel, and containing therein a coordination complex of an alkali, alkaline earth or rare earth metal salt, such complex being of the general formula $M(R)_m.nL$ where M is the cation of an alkali metal, alkaline earth metal or rare earth metal of valency m;

R is the residue of an organic compound of the formula RH where H represents an active hydrogen atom reactive with the metal M and attached either to a heteroatom selected from O, S and N in the organic group R, or to a carbon atom, that hetero or carbon atom being situated in the organic group R close to an electron-withdrawing group, e.g. a heteroatom or group consisting of or containing O, S, or N, or aromatic ring e.g. phenyl, but not including active hydrogen atoms forming part of a carboxyl (COOH) group;

n is a number indicating the number of donor ligand molecules forming dative bonds with the metal cation in the complex, usually up to five in number, more usually an integer of from 1–4, but can be zero when M is a rare earth metal; and L is an organic donor ligand (Lewis base).

In a second aspect, there is provided a fuel containing, as an exhaust gas particulate suppressant, a Lewis base complex as above defined and in an amount sufficient to provide in the fuel from 0.1–500 ppm of the metal M, preferably from 0.1 to 100 ppm, most preferably 0.5 to 50 ppm.

In a different but related aspect of the present invention, it has also been found that in addition to particulate suppression, the additive compositions of this invention containing one or more complexes of the formula $M(R)_m.nL$, lead to reduction in unburnt hydrocarbon emission, not only in the exhaust gas emissions from diesel fuels but from other liquid hydrocarbon fuels as well. Not only that, but the additives also serve to remove preformed soot or carbon deposits in internal combustion engines and fuel injectors of all kinds, including exhaust systems used therewith. Whilst no definitive explanation can yet be given for this, it is suspected that these phenomena are due in part to oxidative catalytic activity of the complex (or to a thermal decomposition product thereof) effective to increase the combustion rate of the fuel and increase the burn off rate of predeposited carbon and soot. Thus in addition to particulate suppression, the additive compositions of this invention have added value as exhaust emission control agents for reducing unburnt hydrocarbon emissions from liquid hydrocarbon fuels, and as clean-up agents for the removal of soot and carbon deposits resulting from the incomplete combustion of liquid hydrocarbon fuels. Amounts of metal complex(es) added to the fuel for these purposes will generally be the same as before, i.e. sufficient to provide a concentration of the metal or metals M in the fuel in the range 0.1 to 500 ppm, preferably 0.1 to 100 ppm, most preferably 0.5 to 50 ppm.

In yet another aspect of the invention therefore there is provided a method of reducing the unburnt hydrocarbon emission of liquid hydrocarbon fuels when combusted, which comprises incorporating into the fuel prior to combustion an alkali, alkaline earth or rare earth metal complex of the formula given above, or a mixture of two or more such complexes in an amount sufficient to provide in said fuel from 0.1 to 500 ppm, preferably 0.1 to 100 ppm of the metal(s) M.

In yet another aspect of the invention them is provided a method of reducing carbon deposits resulting from the incomplete combustion of liquid hydrocarbon fuels, which comprises incorporating into the fuel prior to combustion an alkali, alkaline earth or rare earth metal complex of the formula given above, or a mixture of two or more such complexes, in an amount sufficient to provide in said fuel from 0.1 to 500 ppm, preferably 0.1 to 100 ppm of the metal(s) M.

Referring in more detail to the Lewis base metallo-organic coordination complexes used in accordance with the invention, these are, as indicated, Lewis base coordination complexes of alkali metals, alkaline earth metal and rare earth metal salts of organic compounds containing an "active" hydrogen atom reactive with and replaceable by the metal cation. In the organic compound RH, that active hydrogen atom will be attached to a heteroatom (O, S or N) or to a carbon atom close to an electron-withdrawing group. That electron withdrawing group may be a hetero atom or group consisting of or containing O, S or N, e.g. a carbonyl (>C=O), thione (>C=S) or imide (>C=NH) group, or an aromatic group, e.g. phenyl. When that electron-withdrawing group is a hetero atom or group, that hetero atom or group may be situated in either an aliphatic or alicyclic group, which, when the active hydrogen containing group is an >NH group, may or may not, but usually will contain that group as part of a heterocyclic ring. Preferably the electron-withdrawing group is in the α-position relative to the atom containing the active hydrogen, although it may be further away, the essential requirement being that in the crystalline complex, that electron-withdrawing group is sufficiently close to the metal cation to form a dative bond therewith. The preferred organic compounds, RH, are those in which the active hydrogen atom is attached to a carbon atom in the organic group R, especially an aliphatic carbon atom situated in an aliphatic chain between two carbonyl groups, that is to say a β-diketone.

Especially preferred are complexes derived from a β-diketone of the formula $$R^1C(O)CH_2C(O)R^1$$

where $R^1$ is $C_1$–$C_5$ alkyl or substituted alkyl, e.g. halo-, amino- or hydroxyalkyl, $C_3$–$C_6$ cycloalkyl, benzyl, phenyl or $C_1$–$C_5$ alkylphenyl, e.g. tolyl, xylyl, etc., the two $R^1$ groups being the same or different.

Suitable β-diketones include acetyl acetone: $CH_3C(O)CH_2C(O)CH_3$, hexafluoroacetylacetone (HFA): $CF_3C(O)CH_2C(O)CF_3$, hepta-3,5-dione: $C_2H_5C(O)CH_2C(O)C_2H_5$, 2,2,6,6-tetramethylhepta-3,5-dione (TMHD): $(CH_3)_3CC(O)CH_2C(O)C(CH_3)_3$ etc., etc.

When, in the organic compound RH, the active hydrogen atom is attached to oxygen, suitable compounds include phenolic compounds containing from 6–20 carbon atoms, preferably substituted phenols containing from 1–3 substituents selected from alkyl, aminoalkyl, alkylaminoalkyl, and alkoxy groups of 1–8 carbon atoms, e.g. cresol, guiacol, di-t-butylcresol, dimethylaminomethyl cresol etc. The substituted phenols are particularly preferred.

When the active hydrogen is attached to a nitrogen atom in the organic compound RH, the preferred compounds are heterocyclic compounds of up to 20 carbon atoms containing a —C(Y)—NH—group as part of the heterocycle, Y being either O, S or =NH. Suitable such compounds are succinimide, 2-mercaptobenzoxazole, 2-mercapto-pyrimidine, 2-mercaptothiazoline, 2-mercaptobenzimidazole, 2-oxobenzazole, etc., etc.

As to the organic ligand L, any suitable organic electron donor (Lewis base) may be used, the preferred organic electron donors (Lewis bases) being hexamethylphosphoramide (HMPA), tetramethylethylenediamine (TMEDA), pentamethyldiethylenetfiamine (PMDETA), dimethylpropyleneurea (DMPU) and dimethylimidazolidinone (DMI). Other possible ligands are diethylether ($Et_2O$), 1,2-dimethoxyethane, bis(2-methoxyethyl)ether (diglyme), dioxane, and tetrahydrofuran. It is, however, to be understood that this listing is by no means exhaustive and other suitable organic ligands (Lewis bases) will suggest themselves to persons skilled in the art. The alkali metal and alkaline earth metal complexes will usually contain from 1 to 4 ligand molecules to ensure oil solubility, i.e. the value of n will usually be 1, 2, 3 or 4. In the case of the rare earth metal complexes, the organic groups R may themselves provide sufficient oil solubility to the extent that N can be and often is 0.

The Lewis base metallo-organic salt complexes used in the invention are obtained by reacting a source of the metal M, e.g. the elemental metal, a metal alkyl or hydride, an oxide or hydroxide, with the organic compound RH in a hydrocarbon, preferably aromatic hydrocarbon solvent such as toluene, containing the ligand in the stoichiometric amount or in excess of stoichiometric. Where a metal oxide or hydroxide is used, the reaction proceeds via the route described in more detail in GB-A-2 254 610. In that case the initial product of the reaction is an aquo-complex of the formula $M(R)_m.nL.xH_2O$ containing water as a neutral ligand as well as the donor ligand (L). In that formula M, R, m, and L are as above defined and x is ½,1, 1½, 2 etc., usually 1 or 2. Those aquo-complexes can be recovered in crystalline form from the reaction solution and heated to drive off the neutral ligand, i.e. the water molecules, leaving the anhydrous complex $M(R)_m.nL$. The above reactions and preparative routes are illustrated by equations:

$$M(OH)_m + mRH + nL \xrightarrow{\text{toluene}} M(R)_m.nL.mH_2O \xrightarrow[\text{heat}]{\text{isolate}} M(R)_m.nL \quad \text{i)}$$

$$MO + mRH + nL \xrightarrow{\text{toluene}} M(R)_m.nL.H_2O \xrightarrow[\text{heat}]{\text{isolate}} M(R)_2.nL \quad \text{ii)}$$

$$M + mRH + nL \xrightarrow{\text{toluene}} M(R)_m.nL. + 1/2mH_2 \quad \text{iii)}$$

$$MH_m + mRH + nL \xrightarrow{\text{toluene}} M(R)_m.nL + mH_2 \quad \text{iv)}$$

$$MR_m^1 + mRH + nL \xrightarrow{\text{toluene}} M(R)_m.nL + mR^1H \quad \text{v)}$$

($R^1$ = organic e.g. alkyl)

It will be appreciated that the above routes will not be equally applicable to all the metals M nor to all organic compounds RH. The particular route shown will depend on the materials used, and especially the availability of a suitable source of the metal M. For this reason alone, the most suitable route will usually be either route i) or route ii) indicated above, since the most convenient source of the metal M will usually be the oxide or hydroxide.

Whilst it has already been indicated that the structure of many of the complexes is monomeric, crystallographic studies show some of them to be dimeric or trimeric in structure. This gives rise to the possibility that, within the crystal lattice one metal atom may be replaced by another, different metal atoms giving rise to mixed metal complexes of the general formula indicated, i.e. $M(R)_m.nL$, but where within the crystal structure of the complex M represents two or more different metals. Techniques for the manufacture of such mixed metal complexes are described in GB-A-2 259 701. Such mixed metal complexes, i.e. where M in the formula of the complex represents two or more different alkali, alkaline earth or rare earth metals, are therefore to be included within the scope of that formula, and within the scope of the present invention, as are, of course, mixtures of two or more different complexes.

Whilst any of the alkali (Group Ia; At. Nos. 3, 11, 19, 37, 55), alkaline earth (Group II; At. Nos. 4, 12, 20, 38, 56) or rare earth (At. Nos. 57–71 inclusive) metals may be used as the metal (or metals) M, preferred are the donor ligand complexes of sodium, potassium, lithium, strontium, calcium and cerium.

Whilst the metallo-organic salt complexes described herein as smoke suppressants for liquid hydrocarbon fuels may be added directly to the fuel in amounts sufficient to provide from 0.1 to 500 ppm, preferably 0.1 to 100 ppm, of the metal M in the fuel, they will preferably first be formulated as a fuel additive composition or concentrate containing the complex, or mixtures of the complex possibly along with other additives, such as detergents, antifoams, stabilisers, corrosion inhibitors, cold flow improvers, antifreeze agents, cetane improvers as is well known in the art, in solution in an organic carrier liquid miscible with the fuel. Suitable carrier liquids for this purpose include: aromatic kerosene hydrocarbon solvents such as Shell Sol AB (boiling range 186° C. to 210° C.), Shell Sol R (boiling range 205° C. to 270° C.), Solvesso 150 (boiling range 182° C. to 203° C.), toluene, xylene, or alcohol mixtures such as Acropol 91 (boiling range 216° C. to 251° C.). Other suitable carrier liquids miscible with diesel and other similar hydrocarbon fuels and fuel will be apparent to those of ordinary skill in the art. Concentrations of the metal complex in the additive composition may be as high as 50% by weight, calculated as the metal M, but will more usually be from 0.1 to 20% by wt. of the metal M most usually from 0.5 to 10%.

By "diesel fuel" herein is meant a distillate hydrocarbon fuel for compression ignition internal combustion engines meeting the standards set by BS 2869 Pans 1 and 2. The corresponding standard for heating oils is BS 2869 Part 2.

The invention is illustrated by the following examples and test data.

EXAMPLE 1

Preparation of the 1,3-dimethylimidazolidinone (DMI) Complex of strontium bis-2,2,6,6-tetramethyl-3,5-heptanedionate (TMHD): $Sr(TMHD)_2$. 3DMI 2,2,6,6-tetramethyl-3,5-heptanedione, $(CH_3)_3CC(O)CH_2C(O)C(CH_3)_3$, TMHD (18.54 g, 21 ml, 100.6 mmol) was syringed into a stirred, cooled mixture of dimethylimidazolidinone,

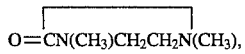

DMI (32.32g, 30ml, 283 mmol) in toluene (20 ml) with a strontium metal lump (ca 6 g, 68 mmol). The mixture was then heated and stirred overnight. The solids which formed were dissolved by adding a further 30 ml of toluene, and then the liquid was filtered and cooled. After several hours, a crystalline product formed which was washed with hexane, isolated and identified as the tris-1,3-dimethylimidazolidinone complex of strontium his-2,2,6,6-tetramethyl -3,5-heptanedionate.

Formula: $Sr[(CH_3)_3CC(—O)=CHC(=O)C(CH_3)_3]_2.3DMI$, Mw 797

Yield: 23 g, first batch, 58% based on TMHD and on a ⅔ ligand: donor ratio.

m.p.: 82° C. sharp, to a clear colourless liquid.

| | Elemental analysis (%) | |
|---|---|---|
| | Found | Theory |
| Sr | 10.99 | 10.6 |
| C | 56.14 | 55.7 |
| H | 8.7 | 8.6 |
| N | 10.3 | 10.3 |

Thermal Analysis
STA
The compound gives a two stage weight loss profile. The first loss, presumably the DMI ligands, are lost steadily from 120° C. to 270° C. followed by what is thought to be volatilisation of the uncomplexed compound from 270°–390° C. leaving a minimal residue (2%) by 400° C.
DSC
A sharp melting point is seen to occur at 82° C. implying a highly pure material.

EXAMPLE 2

Preparation of the 1,3-dimethylimidazolidinone (DMI) complex of potassium 2,2,6,6-tetramethyl-3,5-heptanedionate: K TMHD.2DMI KH (0.90 g, 22.5 mmol) was washed with mineral oil, dried and placed in a Schlenk tube. Hexane was then added followed by DMI (7 ml, 64.22 mmol). Tetramethylheptanedione (4.4 ml, 21.05 mmol) was then added slowly, as a very vigorous reaction takes place. After about fifteen minutes the reaction subsided and an oil settled out of solution. The two-phase liquid was cooled in an ice-box (−10° C.) and some solid crystalline mass formed from the oil pan over half an hour.

The crystalline solids were washed with hexane, isolated and determined to be the bis-1,3-dimethylimidazolidinone (DMI) complex of potassium 2,2,6,6-tetramethyl-3,5-heptanedionate (TMHD).

Formula: $K[(CH_3)_3CC(—O)=CHC(=O)C(CH_3)_3].2$ DMI, Mw 451

Yield: 1.7 g, 16% first batch based on a ½ ligand:donor ratio

| | Elemental Analysis (%) | |
|---|---|---|
| | Found | Theory |
| K | 9.9 | 8.68 |

Thermal Analysis:
STA
A fairly flat curve is seen from ambient to around 270° C. then an apparent one step weight loss occurs until by around 390° C. a small residue remains.
DSC
This shows a fairly wide melting range, peaking at 76° C. and is followed by a sharp endothermic event at 119° C.

EXAMPLE 3

Preparation of the 1,3-dimethylimidazolidinone (DMI) complex of calcium 2,2,6,6-tetramethyl-3,5-heptanedionate: $CaTMHD_2.2DMI$ Calcium hydride (0.42 g, 10.0 mmol) was placed in a Schlenk tube and DMI, (2.2 ml, 20 mmol), toluene (10 ml) and TMHD (4.2 ml, 20.0 mmol) added. The mixture was sonicated for half an hour and then heated and stirred at 90° C. overnight. A powder gradually formed in the solution, and subsequently a thick, solid mass. Addition of toluene to the solid caused it to dissolve. The mixture was filtered then placed in a fridge. A crop of crystals was produced and determined to be the bis-DMI complex of $Ca(TMHD)_2$.

Formula: $Ca[(CH_3)_3CC(—O)=CHC(=O)C(CH_3)_3]_2.$ 2DMI, Mw 635

Yield: 3.6 g, 1st batch 56%.

| | Elemental Analysis (%) | |
|---|---|---|
| | Found | Theory |
| Ca | 6.7 | 6.3 |
| C | 60.16 | 60.26 |
| H | 9.71 | 9.18 |
| N | 8.28 | 8.83 |

Thermal Analysis
STA
The experiment showed that the compound was stable to just below its melting point, then ligand was lost till 275° C. when the rest of the residue volatilised.
DSC
Showed one very sharp melting point at 118° C.

EXAMPLE 4 (cancelled)

EXAMPLE 5

Preparation of the 1,3-dimethylimidazolidinone (DMI) complex of sodium 2-methoxyphenoxide 2-Methoxyphenol $[HOC_6H_4(2\text{-}OCH_3)]$(4.92 g, 4.50 ml, 40.0 mmol) was added slowly to a suspension of Nail (0.96 g 40.0 mmol) in DMI (4.56 g, 5.5 ml, 40.0 mmol) and toluene (40 ml). An exothermic reaction occurred and a clear straw coloured solution was the result. Refrigeration overnight caused a large batch of small crystals to form.

The crystals were washed, dried and determined to be the DMI adduct of sodium 2-methoxyphenoxide.

Formula: $Na[OC_6H_4(OCH_3)]$ DMI, Mw 260

Yield: 7.8 g first batch 75% based on a 1/1 ratio.

m.p.: 87°–89° C. to a clear colourless liquid.

| | Elemental Analysis (%) | |
|---|---|---|
| | Found | Theory |
| Na | 8.4 | 8.8 |
| C | 54.5 | 55.5 |
| H | 6.6 | 6.5 |
| N | 10.9 | 10.7 |

EXAMPLE 6

Preparation of the 1.3-dimethylimidazolidinone (DMI) complex of lithium 2,6,-di-t-butyl-4-methylphenoxide BuLi (7.5 ml of a 2M solution in cyclohexane, 15.0 mmol) was added to 2,4-di-t-butyl-4-methylphenol (3.4 g, 15.5 mmol) and DMI (5.5 ml, 50.0 mmol). A thick white precipitate was obtained which was warmed and dissolved by addition of DMI. Cooling on line followed by refrigeration caused crystallisation.

The crystalline solids were washed with hexane, isolated and determined to be the 1,3-dimethylimidazolidinone complex of lithium 2,6-di-t-butyl-4-methylphenoxide.

Formula: $LiOC_6H_2[2,6\text{-}C(CH_3)_3]_2(4\text{-}CH_3)$.DMI, Mw 340.5

Yield: 2.8 g, 55% first batch.

m.p.: 285° C.

| | Elemental Analysis (%) | |
|---|---|---|
| | Found | Theory |
| Li | 2.81 | 2.84 |
| C | 66.38 | 70.6 |
| H | 9.48 | 9.7 |
| N | 7.54 | 8.2 |

EXAMPLE 7

Preparation of the 1,3-dimethylimidazolidinone (DMI) complex of lithium 2,2,6,6-tetramethyl-3,5-heptanedionate: LiTMHD.2DMI BuLi (75 ml of a 1.6 molar solution in hexane, 0.12 mol) was syringed into a two neck flask under nitrogen. A mixture of TMHD (24.98 ml, 22.1 g, 0.12 mol) and DMI (30 ml, 31.2 g, 0.24 mol) 2 equivalents with hexane (30 ml) were then slowly dripped into the stirred uncooled solution.

The solution became yellow then lightened as the reaction reached the end. Solids then formed which went back into solution and the liquid was allowed to cool to yield a crystalline product. This was redissolved by gentle heating in an oil bath. Hexane (30 ml) was added and the solution cooled once more. The material which re-crystallised was identified as the DMI complex of LiTMHD.

Formula: $Li[(CH_3)_3CC(—O)=CHC(=O)C(CH_3)_3]$.2DMI, Mw 419

Yield: 32 g, 64% first batch m.p.: 89°–90° C.

| | Elemental Analysis (%) | |
|---|---|---|
| | Found | Theory |
| Li | 1.65 | 1.67 |

EXAMPLE 8

Preparation of the 1,3-dimethylhnidazolidinone (DMI) complex of sodium 2,2,6,6tetramethyl-3,5-heptanedionate: Na TMHD.2DMI This complex was prepared using similar methods to Example 2 but with sodium hydride in place of potassium hydride.

Formula: $Na[(CH_33)_3CC(—O)=CHC(=O)C(CH_3)_3]$.2DMI, Mw 435 m.p.: 71°–72° C.

EXAMPLE 9

The preparation of the 1,3-dimethylimidazolidinone (DMI) complex of caesium 2,2,6,6-tetramethyl-3,5-heptanedionate: (TMHD): Cs TMHD.0.2 DMI An ampoule of caesium (2 g, 15.0 mmol), was placed in a Schlenk tube and covered by THF (90 ml). TMHD (3.2 ml, 15.0 mmol) was then added, the temperature controlled to 60° C. and the reaction mixture stirred over-night. A clear yellow solution was obtained. The empty ampoule was removed, and the solution cooled to ambient temperature. All the solvent was then removed to obtain a white solid. Hexane was added (40 ml) and DMI (4 ml) was syringed into the tube to cause dissolution. The liquid was then refrigerated to −20° C.

After two hours a batch of white crystalline material formed, which was then filtered, washed with hexane and isolated. This was identified as a DMI (0.2 equivalent) adduct of CsTMHD.

Formula: $Cs[(CH_3)_3C(—O)=CHC(=O)C(CH_3)_3]$.0.2DMI, Mw 342

Yield: 2.3 g first batch, 45% m.p.: 182°–184° C.

| | Elemental Analysis (%) | |
|---|---|---|
| | Found | Theory |
| C | 42.03 | 41.8 |
| H | 6.05 | 6.02 |
| N | 2.57 | 2.5 |

EXAMPLE 10

Preparation of rubidium 2,2.6,6-tetramethyl-3,5-heptanedionate

This compound was made under similar conditions to those specified in Example 10, using an ampoule of rubidium in place of caesium, but on a 23.0 mmol scale.

Formula: $Rb[(CH_3)_3CC(—O)=CHC(=O)C(CH_3)_3]$, Mw 268.7

| | Found | Theory |
|---|---|---|
| C | 48.77 | 49.1 |
| H | 7.67 | 7.1 |

EXAMPLE 11

Preparation of the 1,3-dimethylimidazolidinone (DMI) complex of:potassium 2,6di-t-butyl-4methylphenoxide This complex was made using potassium hydride in place of BuLi in a similar work up to Example 6, but on a 20.0 mmol scale.

Formula: $KOC_6H_2[2,6\text{-}C(CH_3)_3]_2(4\text{-}CH_3)$.2DMI, Mw 486

Yield: 5.3 g, 57% m.p.: 92°–96° C.

| | Elemental Analysis (%) | |
|---|---|---|
| | Found | Theory |
| K | 8.17 | 8.02 |
| C | 60.91 | 61.7 |
| H | 8.87 | 8.85 |
| N | 11.42 | 11.52 |

EXAMPLE 12

Preparation of the 1,3-dimethylimidazolidinone (DMI) complex of lithium 2,4,6-trimethylphenoxide A similar route was used to that of Example 6, but using 2,4,6-trimethylphenol in place of 2,6-di-t-butyl-4-methylphenol, but on a 90 mmol scale reaction.

Formula: $LiOC_6H_2(2,4,6\text{-}CH_3)_3.1.5DMI$, Mw 313

Yield: 14.8 g, 52% m.p.: 115° C.

| | Elemental Analysis (%) | |
|---|---|---|
| | Found | Theory |
| Li | 2.2 | 2.2 |

EXAMPLE 13

Preparation of the 1,3-dimethylimidazolidinone (DMI) complex of strontium bis-2,4,6-trimethyiphenoxide Strontium metal (4.5 g, excess) and 2,4,6-tri-methylphenol (5.44, 40.0 mmol) were reacted together in DMI (10 ml, ca. 90.0 mmol) and toluene (100 ml) with heat. Filtering and removal of solvent gave a batch of crystals.

Formula: $Sr[OC_6H_2(2,4,6\text{-}CH_3)_3]_2.5DMI$, Mw 929.02

Yield: 12 g, 49% m.p.: 244° C.

| | Elemental Analysis (%) | |
|---|---|---|
| | Found | Theory |
| Sr | 9 | 9.4 |
| C | 53.8 | 55.6 |
| H | 7.3 | 7.7 |
| N | 15.2 | 15.1 |

EXAMPLE 14

Preparation of lithium N,N-dimethyl-2-aminomethylene-4-methylphenoxide

N,N-Dimethyl-2-aminomethylene-4-methylphenol (11.5 g, 57.8 mmol as 97.3% pure), was added slowly to n-BuLi (44 ml of a 1.6M solution in hexane, 70.25 mmol) in toluene (30 ml). A very exothermic reaction occurred and the mixture was cooled whilst addition was taking place. A clear straw coloured solution resulted, which was continually stirred until the temperature dropped to ambient. Solvent was next removed until a white precipitate formed. From which recrystallisation from hexane by refrigeration (12 h) caused large pyramidal crystals to form.

The crystals, which needed to be filtered cold, were washed, dried and determined to be lithiated N,N-dimethyl-2-aminomethylene-4-methylphenoxide.

Formula: $LiOC_6H_3[2\text{-}CH_2N(CH_3)_2](4\text{-}CH_3)$, Mw 171

Yield: 8.4 g, yield 72%.

m,p.: 252°–255° C. to a clear colourless liquid.

| | Elemental Analysis (%) | |
|---|---|---|
| | Found | Theory |
| C | 70.58 | 70.18 |
| H | 8.78 | 8.19 |
| N | 8.22 | 8.19 |
| Li | 4.05/4.04 | 4.09 |

EXAMPLE 15

Preparation of cerium tetrakis-2,2,6,6-tetramethyl-3,5-heptanedionate: $CeTMHD_4$ Cerium chloride, $CeCl_3$ (5.19 g, 21.0 mmol), was placed in a conical flask with a 50% ethanolic solution (100 ml).

In a second flask sodium hydroxide (60.0 mmol) in ethanol (50 ml) was reacted with TMHD (12.5 ml, 60.0 mmol), and this product was added slowly using a dropping funnel to the Ce solution suspension. A red solid in a cloudy solution was obtained. Hexane (150 ml) was added to dissolve organically soluble products and this layer was then transferred to a Schlenk tube after filtration and the liquids removed under vacuum.

A deep red solid was precipitated, dried and collected and determined to be cerium tetrakis-2,2,6,6-tetramethyl-3,5-heptanedionate.

Formula: $Ce[(CH_3)CC(\text{—}O)\text{=}CHC(\text{=}O)C(CH_3)_3]_4$, Mw 873.24

Yield: 8.7 g, 17% m.p.: 276°–277° C.

| | Elemental Analysis (%) | |
|---|---|---|
| | Found | Theory |
| C | 60.93 | 60.5 |
| H | 8.76 | 8.7 |
| Ce | 16 (by SEM) | 16.06 |

EXAMPLE 16

Preparation of cerium tetrakis-2,2,7-trimethyl-3,5-octanedionate: $Ce(TOD)_4$ This compound was prepared in a similar way to Example 8, except that a sodium precursor of trimethyloctanedione, TOD, was used to prepare the compound identified as Ce $TOD_4$.

Formula $Ce[(CH_3)_3CC(=O)=CHC(=O)CH_2CH(CH_3)_2]_4$ Mw 873.24 m.p.: 145° C.

| | Elemental Analysis (%) | |
|---|---|---|
| | Found | Theory |
| C | 60.93 | 60.5 |
| H | 8.76 | 8.7 |

TEST DATA

Static Engine Tests

The above described strontium and calcium complexes were added to a test diesel fuel in amounts sufficient to provide metal concentrations of 1.5 milligram atoms per kg. of fuel and tested for smoke emission in a static Perkins 236 DI single cylinder research engine. The fuel used was a standard European legislative reference diesel fuel, CEC RO3-A84. The blend data were as follows:

TABLE 1

| Metal Complex | Metal Automic Weight | Compound mol. weight | Compound mg/kg fuel | Metal mg/kg fuel | Metal mg/l fuel |
|---|---|---|---|---|---|
| Example 3 | 40.08 (Ca) | 634.92 | 951 | 60 | 50 |
| Example 1 | 87.62 (Sr) | 796.76 | 1023 | 131 | 110 |

The test conditions are given below in Table 2 together with the equivalent test mode of the ECE R49[1] 13 mode cycle.

TABLE 2

| Engine Duty | R49 mode | Engine Speed rpm | Load, Nm |
|---|---|---|---|
| Max torque (hill climb) | 6 | 1350 | 50 |
| Max Power | 8 | 2600 | 40 |
| Max speed (light running) | 11 | 2600 | 10 |

Smoke emission was measured using the Bosch method [2]. In this method a fixed volume of gas is drawn through a filter and the smoke value obtained optically as a function of reduced reflectance.

Heat release was obtained using an AVL Indiskop [3] to record a number of engine parameters from transducers on the engine. In particular cylinder pressure data is used in a computer model to estimate the quantity and timing of heat release resulting from fuel combustion.

RESULTS

Smoke Measurement

These are recorded in Table 3 below. The figures in parentheses refer to the number of test runs.

TABLE 3

| R49 | Base fuel | Base fuel Plus Ca Complex (Example 3) | % Reduction in Bosch smoke | Base fuel Plus Sr Complex (Example 1) | % Reduction in Bosch smoke |
|---|---|---|---|---|---|
| 6 | 2.13(4) | 1.12(1) | 47 | 0.7(3) | 67 |
| 8 | 2.63(4) | 1.17(1) | 56 | 2.17(3) | 17 |
| 11 | 1.65(4) | 0.5(1) | 70 | 1.10(3) | 33 |

TABLE 4

| | Base Fuel | Base Fuel plus Ca Complex (Example 3) | Base Fuel plus Sr Complex (Example 1) |
|---|---|---|---|
| 5% Heat release (deg BTDC) | −8.69 | −8.51 | −8.53 |
| 10% Heat release (deg BTDC) | −8.14 | −7.91 | −7.93 |
| 50% Heat release (deg BTDC) | −2.59 | −1.51 | −1.71 |
| 90% Heat release (deg BTDC) | 16.40 | 39.46 | 37.00 |

Footnotes:

1. ECE R49 see:
European 13-Mode Cycle - 9037/86. Transposed into EEC COUNCIL DIRECTIVE 88/76EEC.
2. Bosch smoke measurement see:
0681 169 038 EFAW 65A
0681 168 038 EFAW 68A
Robert Bosch GmbH
Stuttgart
3. AVL 647 Indiskop see:
Version MIP A/E 6.4 with supplement to
Version MIP A/E 7.0
AVL List GmbH
Kleiss Strasse 48, A-8020
Graz. Austria.

Vehicle Smoke Emission—DI Truck

These were carded out on a small commercial flat body truck equipped with a standard optional Perkins NA Phaser diesel engine (specification: see Appendix 1). The fuel delivery system was modified to enable easy switching between the test fuels with no inter-fuel contamination.

The base fuel used was a standard commercial UK Derv. (see Appendix 2). The smoke suppressant complex was first dissolved in a small volume (10 ml) Shell Sol AB (aromatic kerosene solvent bp 210° C.) prior to addition to the fuel in amounts sufficient to yield metal concentration in the fuel of 1, 10 and 100 ppm.

All of these vehicle tests were made on a chassis or roller dynamometer that had been set to simulate the road drag power of the truck. The test procedures were as set out in the US Code of Federal Regulations. Title 40. Part 86 and Part 600. Springfield, National Technical Information Service 1989.

Part 86 refers to the Urban drive schedule test, which consists of three phases. These are the Cold transient (CT), Stabilised (S) and Hot transient (HT) phases. FTP is used here to indicate the overall result, which is a weighed average of the three phases.

Part 600 refers to the Highway fuel economy test (HWFET). Here further abbreviated to (HW).

Operation of the truck and analysis of the exhaust emissions were, apart from the specification of the fuel and the measurement particulates during the HW. as set out in the US Code of Federal Regulations above.

The results are presented in Table 5 in which the following abbreviations are used:

CT: Cold Transient Test. Engine run for 505 seconds after "cold soaking" the engine overnight at 20°–30° C.

S: Stabilised Test. Carried out immediately after the CT test and tests for 866 seconds.

HT: Hot Transient Test. Carried out 10 minutes after the Stabilised Test.

The CT,S and HT tests include the US Federal Urban Drive Schedule, a 3-phase test, details to be found in US Code of Federal Regulations, Title 40, Part 86.

FTP is the Federal Test Procedure, US Code of Federal Regulations, Title 60, Part 600.

HW is a Highway drive cycle normally formed as part of the Highway Fuel Economy Test.

The results presented in Tables 3, 5 and 6 clearly show the fine particle suppressant properties of the present compounds when added to diesel fuel and the reduction in hydrocarbon emission.

In the Tables, the particulate and unburnt hydrocarbon emission is calculated and expressed as function of distance, i.e. g/km, and the results given are the average of two runs.

TABLE 5A

| Particulates Emission (g/km) (Additive = Sr Complex, Example 1) | | | | |
|---|---|---|---|---|
| | | Base Fuel plus additive | | |
| Test | Base Fuel | 1 ppm (Sr) | 10 ppm (Sr) | 100 ppm (Sr) |
| CT | 0.248 | 0.216 (−12.9%) | 0.223 (−10.1%) | 0.226 (−8.9%) |
| S | 0.222 | 0.214 (−3.6%) | 0.205 (−7.7%) | 0.215 (−3.2%) |
| HT | 0.237 | 0.228 (−3.8%) | 0.244 (+2.9%) | 0.256 (+8.0%) |
| FTP | 0.229 | 0.218 (−4.8%) | 0.219 (−4.4%) | 0.228 (0%) |
| HW | 0.119 | 0.103 (−13.4%) | 0.118 (−15.5%) | 0.103 (−13.4%) |

TABLE 5B

| Particulates Emission, (g/km) (Additive = Sr Complex (Example 1) plus K Complex (Example 2) | | |
|---|---|---|
| Test | Base Fuel | Base Fuel plus additive 10 ppm Sr and K |
| CT | 0.248 | 0.217 (−12.5%) |
| S | 0.222 | 0.222 (0%) |
| HT | 0.237 | 0.244 (+2.1%) |
| FTP | 0.229 | 0.227 (−0.9%) |
| HW | 0.119 | 0.113 (−5.0%) |

TABLE 6A

| Hydrocarbon Emission (g/km) (Additive = Sr Complex, Example 1) | | | | |
|---|---|---|---|---|
| | | Base Fuel plus additive | | |
| Test | Base Fuel | 1 ppm (Sr) | 10 ppm (Sr) | 100 ppm (Sr) |
| CT | 0.655 | 0.557 (−15.0%) | 0.545 (−16.8%) | 0.55 (−16.0%) |
| S | 0.946 | 0.836 (−11.6%) | 0.82 (−13.3%) | 0.817 (−13.6%) |
| HT | 0.588 | 0.538 (−8.5%) | 0.53 (−9.9%) | 0.535 (−9.0%) |
| FTP | 0.788 | 0.697 (−11.5%) | 0.684 (−13.2%) | 0.685 (−13.1%) |
| HW | 0.353 | 0.358 (+1.4%) | 0.326 (−6.8%) | 0.363 (+2.8%) |

TABLE 6B

| Hydrocarbon Emmission (g/km) (Additive = Sr Complex, Example 1 and K Complex, Example 2) | | |
|---|---|---|
| Test | Base Fuel | Base Fuel plus additive 10 ppm (Sr + K) |
| CT | 0.655 | 0.518 (−20.9%) |
| S | 0.946 | 0.731 (−22.7%) |
| HT | 0.588 | 0.528 (−10.2%) |

TABLE 6B-continued

| Hydrocarbon Emmission (g/km) (Additive = Sr Complex, Example 1 and K Complex, Example 2) | | |
|---|---|---|
| Test | Base Fuel | Base Fuel plus additive 10 ppm (Sr + K) |
| FTP | 0.788 | 0.632 (−19.8%) |
| HW | 0.353 | 0.346 (−2.0%) |

TABLE 6C

| Hydrocarbon Emission (g/km) (Additive = Ca Complex, Example 3) | | |
|---|---|---|
| Test | Base Fuel | Base Fuel plus additive 10 ppm (Ca) |
| CT | 0.655 | 0.577 (−11.9%) |
| S | 0.946 | 0.858 (−9.3%) |
| HT | 0.588 | 0.551 (−6.3%) |
| FTP | 0.788 | 0.716 (−9.1%) |
| HW | 0.353 | 0.368 (+4.2%) |

Vehicle Smoke Emission Tests—Diesel Car

These were carried out on a Peugeot 309 car equipped with an XUD 9 IDI engine (specification: see Appendix 3). The fuel system of the vehicle had been modified to enable easy switching between the test fuels with no interfuel contamination.

The baseful used was a standard commercial UK DERV (see Appendix 4). The various additives evaluated were dissolved directly into diesel fuel in amounts sufficient to yield a metal concentration in the fuel of 10 ppm.

All of the vehicle tests were made on a chassis or roller dynamometer that had been set to simulate the road drag power of the car. Exhaust particulate samples were taken from a dilution tunnel using the principles specified in EC Directive, 91/441 EEC and US FTP test procedures. The exhaust gas was sampled with the vehicle operating at 70 kph constant speed for a distance equivalent to 12 km.

The weight increase of the filter papers following the test period were calculated and reflect the emissions of particulate from the engine. The results give in Table 7 clearly show the benefits of the additives of this invention in reducing smoke emissions from motor vehicle diesel engines.

TABLE 7

| Peugeot 309 XUD 9 IDI Engine Constant Speed of 70 kmph | | | | | |
|---|---|---|---|---|---|
| | | | Particulates (g/km) | Mean (g/km) | Reductions (%) |
| Base | Run 1 | 12 km | 0.0620 | 0.0622 | 0.0 |
| | Run 2 | 12 km | 0.0626 | | |
| | Run 3 | 12 km | 0.0619 | | |
| Additive Example 8 | Run 1 | 12 km | 0.0631 | 0.0615 | 1.1 |
| | Run 2 | 12 km | 0.0679 | | |
| | Run 3 | 12 km | 0.0535 | | |
| Additive Example 2 | Run 1 | 12 km | 0.0529 | 0.0553 | 11.0 |
| | Run 2 | 12 km | 0.0577 | | |
| | Run 3 | 12 km | 0.0554 | | |
| Additive Example 1 | Run 1 | 12 km | 0.0470 | 0.0440 | 29.3 |
| | Run 2 | 12 km | 0.0440 | | |
| | Run 3 | 12 km | 0.0409 | | |
| Additive 50/50 Example 7/12 | Run 1 | 12 km | 0.0523 | 0.0568 | 8.6 |
| | Run 2 | 12 km | 0.0568 | | |
| | Run 3 | 12 km | 0.0614 | | |

Static Engine Tests—Measurement of Smoke and Hydrocarbon Emissions

Tests were carried out to examine the smoke reducing effects of a number of additives. The tests were made using the static Perkins 236 DI single cylinder research engine. It was a direct injection design and was normally aspirated.

The engine exhaust was arranged to flow through a Celesco (Obscurity type) smoke meter. Bosch smoke number of the exhaust gas was also measured as a verification of the Celesco method, although the discrimination of the Bosch method is less than that of the Celesco.

The unburned hydrocarbons in the exhaust were measured by sampling through a heated sample line to a Flame ionisation detector (FID). This measured unburned exhaust hydrocarbons as Carbon 1 equivalent. (Methane equivalent concentration in terms of parts per million volumes).

The fuel pump was a single plunger type and arrangements were made to change fuel source without contamination of one fuel by another.

An engine test condition of 1350 rev/min equivalent to maximum torque operation (R49 mode 6) was chosen to compare the smoke effects of the additised fuels with those of the same fuel without additive. The test programme was arranged so that the smoke meter reading of an untreated baseline fuel was measured before and after the smoke reading taken from the engine running with each candidate additised fuel. The benefit of the fuel additive could be determined by comparing the smoke value to the average of the bracketing basefuel smoke values. The base fuel was a standard commercial UK Derv (see Appendix 4). The results of the tests are summarised in the following Table 8.

TABLE 8

| PERCENT REDUCTION DUE TO ADDITIVE | | | |
|---|---|---|---|
| Additive Example | Bosch Smoke Number | Celesco Smoke % Obscurity | Hydrocarbons as $CH_4$ |
| 1 | 3.37 | 9.28 | 6.15 |
| | 8.59 | 7.11 | 10.06 |
| | 6.67 | 7.62 | 5.58 |
| 2 | 2.70 | 17.92 | 24.98 |
| 3 | 2.02 | 5.29 | −3.37 |
| 7 | 4.62 | 13.76 | 20.60 |
| 8 | 5.26 | 11.77 | 14.21 |
| | 10.16 | 13.70 | 28.59 |
| 10 | 1.54 | 6.12 | 17.83 |
| 11 | 10.37 | 3.68 | 12.15 |
| 12 | 9.32 | 21.67 | 6.17 |
| 13 | 10.67 | 15.44 | 14.15 |
| 14 | 6.45 | 11.70 | 23.75 |
| 15 | 10.59 | 14.02 | −15.07 |
| 1/8 (50/50) | 3.94 | 9.36 | 23.31 |

APPENDIX 1

| | |
|---|---|
| Make: | Renault 50 Series Truck |
| First Registered: | 14th August 1990 |
| Unladen Weight: | 2341 Kg |
| Max. Laden Weight: | 3500 Kg |
| Test Inertia Weight Used For These Tests: | 2438 Kg |
| Perkins: | 4.40 Q1 |
| Engine Capacity: | 3990 $cm^3$ |
| Rated Power: | 59.7 kW at 2800 rpm |
| Compression ratio: | 16.5:1 |
| Bore: | 100 mm |
| Stroke: | 127 mm |
| Direct injection design | |
| Normally aspirated | |
| Fuel Pump Bosch type EPVE | |
| Transmission: | Rear wheel drive - (The outer of the twin rear driving wheels was removed for the dynamometer testing only. This is to allow the wheels to fit within the dynamometer rolls length). |
| Gearbox: | 5 speed manual shift |
| Final drive ratio: | 3.53:1 |

APPENDIX 2

| | |
|---|---|
| Density @ 15° C. | 0.8379 |
| Viscosity @ 40° C. | 2.842 |
| Cloud Point °C. | −3 |
| CFPP °C. | −22 |
| Pour Point °C. | −22 |
| Flash Point °C. | 67 |
| Sulphur % wt. % | 0.184 |
| FIA: - | |
| % vol. Saturates | 64.4 |
| % vol. Olefins | 2.4 |
| % vol. Aromatics | 33.2 |
| Distillation. IBP @ °C. | 168 |
| 5% vol. @ °C. | 198 |
| 10% vol. @ °C. | 212 |
| 20% vol. @ °C. | 234 |
| 30% vol. @ °C. | 251 |
| 40% vol. @ °C. | 265 |
| 50% vol. @ °C. | 276 |
| 65% vol. @ °C. | 292 |
| 70% vol. @ °C. | 298 |
| 85% vol. @ °C. | 322 |
| 90% vol. @ °C. | 334 |
| 95% vol. @ °C. | 353 |
| FBP @ °C. | 369 |
| % vol. Recovery | 98.5 |
| % vol. Residue | 1.4 |
| % vol. Loss | 0.1 |
| Cetane Number | 50.3 |
| Cetane Improver | NIL |

APPENDIX 3

| | |
|---|---|
| Make | Peugeot 309 1.9 diesel |
| First Registered | 15th February 1989 |
| Unladen wt. | 904 kg |
| Engine type | XUD9 Type 162.4/OHC |
| Engine capacity | 1905 $cm^3$ |
| Rated power | 47 kW @ 4600 rev/min |
| Compression ratio | 23.5:1 |
| Bore | 83 mm |
| Stroke | 88 mm |
| Fuel pump | CAV rotodiesel DPC 047 |
| Transmission | Front wheel drive |
| Gear box | 5-speed (manual) |
| Registration | F798 JCA |
| Engine No. | 162 - 140898 |
| Injecter Assembly | CAV LCR 67307 |
| Injecter nozzle | RDNG SDC 6850 |

APPENDIX 4

| | |
|---|---|
| Density @ 15° C. | 0.8373 |
| Viscosity @ 40° C. | 2.988 |
| Cloud Point, °C. | −3 |
| CFPP, °C. | −17 |
| Pour Point, °C. | −21 |
| Flash Point, °C. | 67 |
| Sulphur, % wt | 0.17 |
| FIA analysis | |
| % vol Saturates | 73.2 |
| % vol Olefins | 1.3 |
| % vol Aromatics | 25.5 |
| Distillation, IBF @ °C. | 177 |
| 5% vol @ °C. | 200 |
| 10% vol @ °C. | 213 |
| 20% vol @ °C. | 237 |

APPENDIX 4-continued

| | |
|---|---|
| 30% vol @ °C. | 255 |
| 40% vol @ °C. | 269 |
| 50% vol @ °C. | 280 |
| 65% vol @ °C. | 296 |
| 70% vol @ °C. | 301 |
| 85% vol @ °C. | 324 |
| 90% vol @ °C. | 335 |
| 95% vol @ °C. | 351 |
| FBP @ °C. | 364 |
| % vol Recovery | 98.6 |
| % vol Residue | 1.4 |
| % vol Loss | 0.0 |
| Cetane Number | 52.3 |
| Cetane Improver, % | NIL |

We claim:

1. An additive composition for liquid hydrocarbon fuels effective to reduce particulate emission when the fuel is burned and/or reduce unburnt hydrocarbon emission, the additive composition comprising one or more oil-soluble Lewis base metallo-organic complexes consisting of the formula $M(R)_m.nL$ where M is the cation of an alkali metal, an alkaline earth metal, or a rare earth metal of valency m, not all metal cations (M) in the complex necessarily being the same;

R is the residue of an organic compound RH, where R is an organic group containing an active hydrogen atom H replaceable by the metal M and attached to an O, S, N or C atom in the group R, that R group containing an electron withdrawing group adjacent or close to the O, S, N or C atom carrying the active H atom and being in a position to form a dative bond, in said complex, with the metal cation M, but not including active hydrogen atom(s) forming part of a carboxyl group (COOH);

n is a positive number indicating the number of donor ligand molecules forming a dative bond with the metal cation, but which can be zero when M is a rare earth metal cation; and L is an organic donor Ligand (Lewis base); in solution in an organic carrier liquid miscible in all proportions with the fuel.

2. An additive composition according to claim 1, where M in said formula is the cation of an alkali or alkaline or rare earth metal.

3. An additive composition according to claim 2, where M in said formula is Li, Na, K, Sr, Ca or Ce.

4. An additive composition according to claim 1, where R is an organic group of from 1–25 carbon atoms.

5. An additive composition according to claim 4 wherein the electron-withdrawing group in the organic group R is a hetero atom or group consisting of or containing as the hetero atom O, S or N.

6. An additive composition according to claim 5, where the electron withdrawing group in R is C=O,C=S or C=NH.

7. An additive composition according to claim 4 where R is the residue of a β-diketone.

8. An additive composition according to claim 1, where R is the residue of a β-diketone of the formula $$R^1C(O)CH_2C(O)R^1$$

where $R^1$ is a substituted or unsubstituted $C_1$–$C_5$ alkyl group, $C_3$–$C_6$ cycloalkyl, phenyl, $C_1$–$C_5$ substituted phenyl, or benzyl, the $R^1$ groups being the same or different.

9. An additive composition according to claim 5 where R is the residue of a heterocyclic group containing an $$-\overset{\overset{\displaystyle Y}{\|}}{C}-NH-$$

group as part of the heterocycle, where Y is O, S or NH.

10. An additive composition according to claim 1, wherein R is a phenolic residue.

11. An additive composition according to claim 10, wherein R is the residue of a substituted phenol containing from 1 to 3 substituents selected from alkyl, alkoxy, aminoalkyl and alkylaminoalkyl groups of from 1 to 8 carbon atoms.

12. An additive composition according to claim 1, where n is 1, 2, 3 or 4.

13. An additive composition according to claim 1, where L is HMPA, TMEDA, PMDETA, DMPU or DMI.

14. An additive composition according to claim 1, wherein the carrier liquid is an aromatic solvent.

15. An additive composition according to claim 1 containing from 0.1 to 50% by wt. of the metal(s) M.

16. A liquid hydrocarbon fuel containing a Lewis base metallo-organic coordination complex of the formula defined in claim 1, in an amount sufficient to provide from 0.1–100 ppm of the metal M in said fuel.

17. A fuel according to claim 16 which is a distillate hydrocarbon fuel.

18. A fuel according to claim 17, which is a diesel fuel.

19. A fuel according to claim 17, which is a heating oil.

20. A method of reducing the particulate emissions from liquid hydrocarbon fuels, which comprises incorporating into the fuel prior to combustion an alkali, alkaline earth or rare earth metal complex of the formula defined in claim 1, or a mixture of two or more such complexes in an amount sufficient to provide in said fuel from 0.1 to 100 ppm of the metal(s) M.

21. A method of reducing the unburnt hydrocarbon emission of liquid hydrocarbon fuels when combusted, which comprises incorporating into the fuel prior to combustion an alkali, alkaline earth or rare earth metal complex of the formula defined in claim 1, or a mixture of two or more such complexes in an amount sufficient to provide in said fuel from 0.1 to 100 ppm of the metal(s) M.

22. A method of reducing carbon deposits resulting from the incomplete combustion of liquid hydrocarbon fuels, which comprises incorporating into the fuel prior to combustion an alkali, alkaline earth or rare earth metal complex of the formula defined in claim 1, or a mixture of two or more such complexes in an amount sufficient to provide in said fuel from 0.1 to 100 ppm of the metal(s) M.

* * * * *